US006480683B2

(12) United States Patent
Hagiwara

(10) Patent No.: US 6,480,683 B2
(45) Date of Patent: Nov. 12, 2002

(54) DEVICE FOR ADJUSTING A DEVELOPING SOLUTION FOR AN ELECTROSTATIC WET-TYPE ELECTROPHOTOGRAPHIC PRINTER

(75) Inventor: Yoshihiro Hagiwara, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/759,325

(22) Filed: Jan. 16, 2001

(65) Prior Publication Data

US 2001/0008585 A1 Jul. 19, 2001

(30) Foreign Application Priority Data

Jan. 17, 2000 (JP) ..... 2000-007382

(51) Int. Cl.[7] ..... G03G 15/10
(52) U.S. Cl. ..... 399/57
(58) Field of Search ..... 399/57, 237, 239, 399/58

(56) References Cited

U.S. PATENT DOCUMENTS 5,781,828 A * 7/1998 Caruthers, Jr. et al. ..... 399/57
5,926,668 A * 7/1999 Lee ..... 399/57
5,970,273 A * 10/1999 Zenk et al. ..... 399/12
6,011,943 A * 1/2000 Kim ..... 399/238

FOREIGN PATENT DOCUMENTS

| | | |
|---|---|---|
| JP | 7-44025 | 2/1995 |
| JP | 11-202728 | * 7/1999 |
| JP | 11-282256 | 10/1999 |
| JP | 2000298402 | * 10/2000 |

* cited by examiner

*Primary Examiner*—Quana M. Grainger
(74) *Attorney, Agent, or Firm*—McGinn & Gibb, PLLC

(57) ABSTRACT

A concentration sensor 11*y* and a level sensor 12*y* measure the toner concentration and the volume of a developing solution in a storage tank 3*y*. A carrier feed pump 6 and a toner feed pump 7*y* are driven and controlled in real time based upon values detected by the sensors 11*y* and 12*y* during the printing operation, in order to feed a concentrated toner or a liquid carrier into the storage tank 3*y* to maintain the volume and the toner concentration of the developing solution in the storage tank 3*y* within predetermined ranges. The concentration and the volume are adjusted in real time during the printing operation which therefore needs not be interrupted for adjusting the developing solution. This makes it possible to continue the printing operation for extended periods of time.

8 Claims, 9 Drawing Sheets

DEVICE FOR ADJUSTING A DEVELOPING SOLUTION FOR AN ELECTROSTATIC WET-TYPE ELECTROPHOTOGRAPHIC PRINTER

BACKGROUND OF THE INVENTION

1. Field of the Invention

This invention relates to an improved device for adjusting a developing solution for an electrostatic wet-type electrophotographic printer.

2. Description of the Related Art

Electrostatic wet-type electrophotographic printers have been known already, for example, in Japanese Unexamined Patent Publications No. H7-44025 and H11-282256, namely 44025/1995 and 282256/1999. In each printer, the toner concentration and volume of a developing solution in a storage tank are maintained in predetermined ranges by controlling the amounts of a liquid carrier and of a concentrated toner fed into the storage tank.

The electrostatic wet-type electrophotographic printers of this kind are equipped with a concentration sensor for measuring the toner concentration of the developing solution in the storage tank and a level sensor for measuring the volume of the developing solution in the storage tank. In addition, control means executes the arithmetic operation based on the values detected by the sensors and controls a carrier feed pump and a toner feed pump in order to maintain the toner concentration and volume of the developing solution in the storage tank within predetermined ranges.

That is, when the toner concentration of the developing solution is unnecessarily high, the carrier feed pump is driven to feed the liquid carrier into the storage tank thereby to decrease the toner concentration. When the toner concentration is low, on the other hand, the toner feed pump is driven to feed the concentrated toner into the storage tank to increase the toner concentration.

Further, when the volume of the developing solution becomes unnecessarily large in the storage tank, a developing solution drain pump is driven to drain an excess of the developing solution. On the other hand, when the volume of the developing solution becomes insufficient, the carrier feed pump is driven to feed the liquid carrier into the storage tank and thereby to increase the amount of the developing solution.

According to the conventional electrostatic wet-type electrophotographic printers disclosed in Japanese Unexamined Patent Publications No. 44025/1995 and 282256/1999, however, the carrier feed pump and the toner feed pump are driven only during a time interval in which the printing operation is not executed. When the printing operation is continued for extended periods of time, therefore, the toner concentration and volume of the developing solution fluctuate to undesired levels, which may make it difficult to properly conduct the printing. This is because the carrier feed pump and the toner feed pump do not operate so far as the printing operation is conducted.

When the volume of the developing solution becomes insufficient, the carrier feed pump only is driven to feed the liquid carrier. This causes such a trouble to occur such that the toner concentration of the developing solution decreases temporarily.

Further, the passage has been opened at all times between the storage tank that stores the developing solution and a developer, and the developing solution feedback passage has also been opened at all times to feed the developing solution used by the developer back to the storage tank. When the device is left to stand for extended periods of time, therefore, the liquid carrier volatilizes through these portions; i.e., the concentration of the developing solution becomes dense so that the printing operation is impaired when it is subsequently executed.

SUMMARY OF THE INVENTION

It is therefore an object of this invention to provide a device for adjusting a developing solution for an electrostatic wet-type electrophotographic printer, which is free from the defects inherent in the above prior art.

It is a specific object of this invention to provide a device of the type described, which is capable of flawlessly executing the printing operation continuously for extended periods of time while properly maintaining the toner concentration and volume of the developing solution at all times. Such a device does not permit the liquid carrier to be undesirably volatilized even when the device is left to stand.

This invention is concerned with a device for adjusting a developing solution for an electrostatic wet-type electrophotographic printer. Specifically, the device comprises: a storage tank for storing the developing solution; a carrier cartridge for storing a liquid carrier; a toner cartridge for storing a concentrated liquid toner; a carrier feed pump for feeding the liquid carrier in the carrier cartridge into the storage tank; a toner feed pump for feeding the concentrated toner in the toner cartridge into the storage tank; a storage tank stirrer for stirring the liquid carrier and the concentrated toner fed into the storage tank to prepare a developing solution; a developer for effecting the developing with the developing solution fed from the storage tank; a developing solution feedback passage for feeding the developing solution used by the developer back to the storage tank; and developing solution drain means for draining an excess of the developing solution in the storage tank into the toner cartridge.

In order to accomplish the above object, provision is further made of: a concentration sensor for measuring the toner concentration of the developing solution in the storage tank; a level sensor for measuring the volume of the developing solution in the storage tank; and control means for controlling, in real time, the carrier feed pump and the toner feed pump based upon values detected by the concentration sensor and the level sensor during the printing operation, in order to adjust the volume and the toner concentration of the developing solution in the storage tank so as to lie within predetermined ranges.

The toner concentration and the volume of the developing solution in the storage tank are measured during the printing operation, and the carrier feed pump and the toner feed pump are controlled in real time based on the measured values. Accordingly, the toner concentration and the volume of the developing solution are adjusted even during the printing operation. Even when the printing operation is continued for extended periods of time, therefore, the toner concentration and the volume of the developing solution are maintained within suitable ranges, and the printing operation is properly conducted at all times.

Further, the developing solution drain means can be constituted by a developing solution drain pump. In this case, the control means is furnished with a function for controlling the developing solution drain pump to control the developing solution drain pump in addition to controlling the carrier feed pump and the toner feed pump.

It is also allowable to constitute developing solution drain means by utilizing the overflow from the storage tank. In this case, however, if an overflow takes place as a result of feeding the concentrated toner or the liquid carrier for adjusting the toner concentration of the developing solution, it is probable that the unadjusted developing solution only existing in the storage tank may overflow, or the newly fed concentrated toner or the liquid carrier only before being stirred may overflow, without properly adjusting the concentration. The developing solution drain pump is driven to maintain the level of the developing solution within a predetermined range in the storage tank. This makes it possible to prevent undesired overflow, and to properly adjust the concentration upon feeding the concentrated toner and the liquid carrier and, particularly, to adjust the concentration during the printing operation.

It is further desired that the control means is provided with a function for feeding the developing solution of a standard concentration by driving the carrier feed pump and the toner feed pump for only a preset period of time in feeding the developing solution.

Then, upon properly setting a ratio of operation times of the carrier feed pump and the toner feed pump, the developing solution of a standard concentration can be fed into the storage tank. This eliminates a defect in the prior art in that the toner concentration fluctuates as a result of feeding the liquid carrier only.

Moreover, the storage tank is of a sealed structure, normally-closed valves are disposed between the developer and the storage tank and in the developing solution feedback passage, and the control means is provided with a valve opening/closing function for opening or closing the valves upon detecting the start and end of the printing operation.

According to this constitution, the storage tank is completely sealed at all times when the printing operation is not being executed, preventing a change in the concentration of the developing solution caused by the volatilization of the liquid carrier.

When the normally-closed valves are disposed between the developer and the storage tank and in the developing solution feedback passage, it is desired that the control means is provided with a valve closure delay function for inhibiting the closure of the valves at the time of adjusting the volume and the toner concentration of the developing solution in the storage tank.

According to this constitution, the developing solution is maintained circulating between the storage tank and the developer even after the end of the printing operation until the completion of adjustment of the volume and toner concentration of the developing solution. Even in case the adjustment of the volume and the toner concentration of the developing solution is started just at the time of ending the printing operation, therefore, the unadjusted developing solution does not remain in the flow passage connecting the storage tank to the developer, and the developer commences the processing with the developing solution of an optimum concentration from a moment when the printing operation is started next.

In the case of an electrostatic wet-type electrophotographic color printer, it is necessary to provide storage tanks, storage tank stirrers, toner cartridges, toner feed pumps, developing solution feed pumps, developing solution feedback passages, concentration sensors and level sensors in a plural number to meet the number of the developers, but the carrier cartridge and the carrier feed pump may be provided in a number of one, respectively.

In this case, the storage tanks and the carrier feed pumps are connected together through the normally-closed carrier feed valves provided for the storage tanks, and the control means is provided with a selection function for selecting a toner feed pump, a developing solution drain pump, a concentration sensor, and a level sensor and a carrier feed valve to be opened, that are corresponding to a storage tank in which the volume and the toner concentration are to be adjusted.

DESCRIPTION OF THE PREFERRED EMBODIMENTS

Described below with reference to the drawings is an embodiment of when the invention is applied to an electrostatic wet-type electrophotographic color printer.

Figure 1:
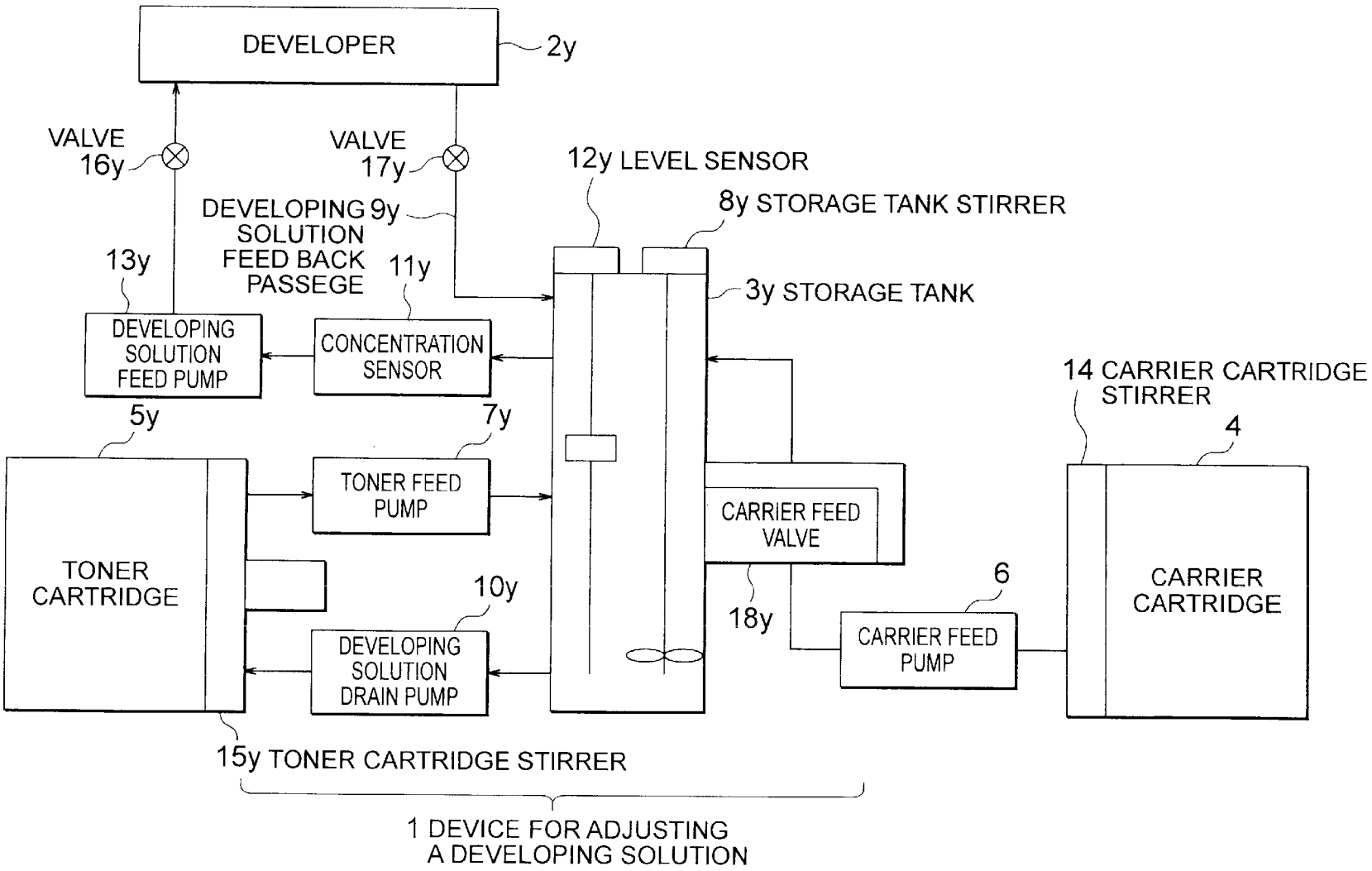
FIG. 1 is a block diagram schematically illustrating the constitution of elements of a device for adjusting a developing solution of one system only according to an embodiment of the present invention.

FIG. 1 is a block diagram illustrating a developer 2*y* which is one of plural developers arranged for color printing having relationships to the portions of a device for adjusting a developing solution.

Referring to FIG. 1, the device 1 for adjusting the developing solution of this embodiment is roughly constituted by a developer 2*y*, a storage tank 3*y*, a carrier cartridge 4, a toner cartridge 5*y*, a carrier feed pump 6, a toner feed pump 7*y*, a stirrer 8*y* for the storage tank, a developing solution feedback passage 9*y*, a developing solution drain pump 10*y*, a developing solution feed pump 13*y*, a concentration sensor 11*y* and a level sensor 12*y*.

Further, the carrier cartridge 4 is provided with a carrier cartridge stirrer 14 for stirring a liquid carrier in the cartridge, and the toner cartridge 5*y* is provided with a toner cartridge stirrer 15*y* for stirring a concentrated toner in the cartridge.

Among them, at least the carrier feed pump 6, toner feed pump 7*y*, developing solution drain pump 10*y* and developing solution feed pump 13*y* are driven and controlled by control means constituted by a CPU and a memory. Further, data related to the concentration and volume of the developing solution detected by the concentration sensor 11*y* and the level sensor 12*y*, are input to a CPU which constitutes the control means (hereinafter simply referred to as CPU).

In this embodiment, further, normally-closed valves 16*y* and 17*y* are disposed between the developer 2*y* and the developing solution feed pump 13*y* and in the developing solution feedback passage 9*y*, and are opened and closed by the CPU.

The carrier feed pump 6 and the toner feed pump 7*y* are driven to feed the liquid carrier in the carrier cartridge 4 and the concentrated toner in the toner cartridge 5*y* into the storage tank 3*y*. By being stirred by the storage tank stirrer 8*y*, a developing solution of a suitable concentration is formed and stored in the storage tank 3*y*, and is sent to the developer 2*y* by the developing solution feed pump 13*y* to effect a predetermined printing. The developing solution used by the developer 2*y* is recovered by the storage tank 3*y* through the developing solution feedback passage 9*y*, and an excess of the developing solution in the storage tank 3*y* is recovered by the toner cartridge 5*y* by driving the developing solution drain pump 10*y*.

Figure 2:
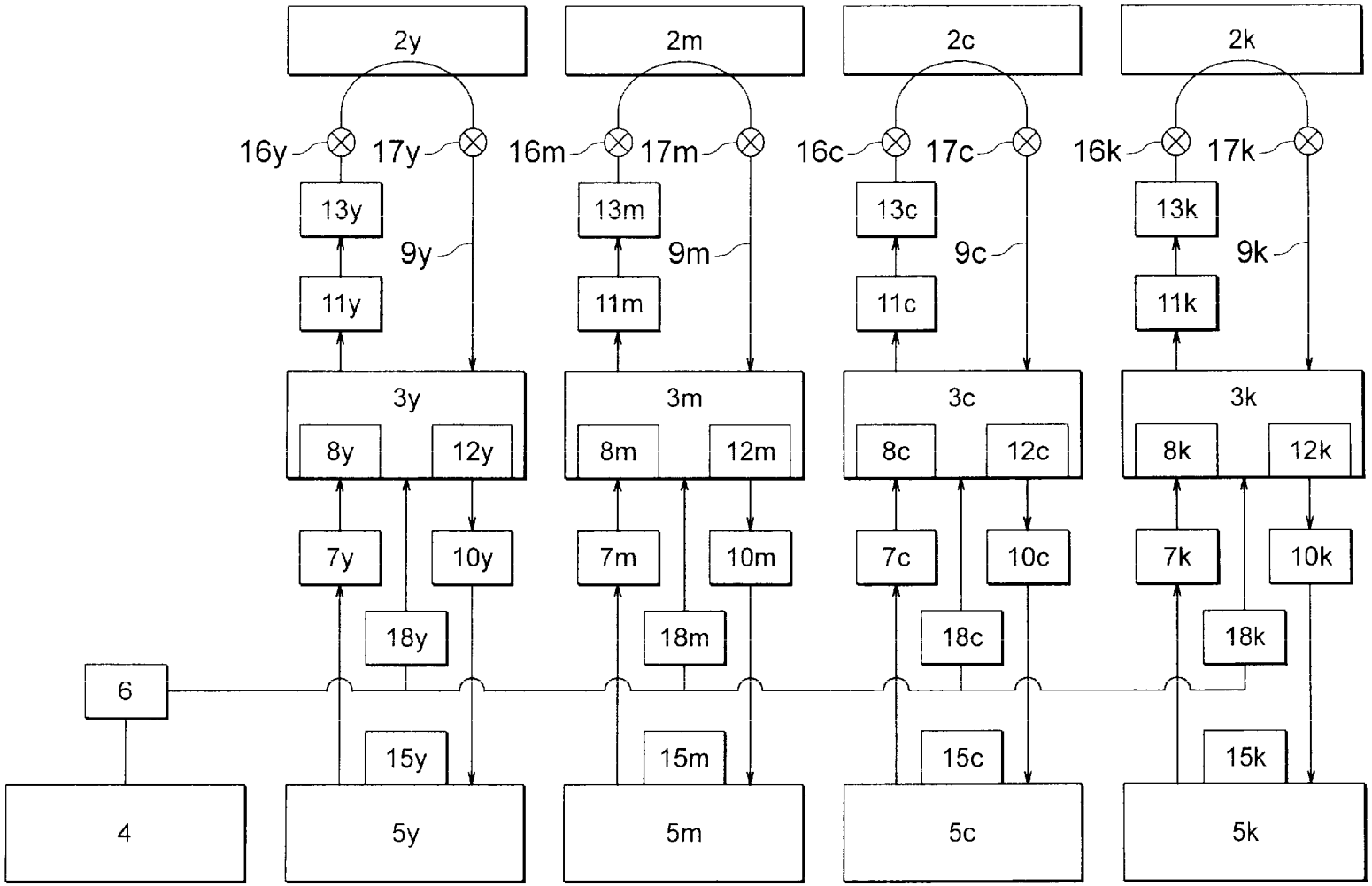
FIG. 2 is a schematic diagram simply illustrating the connection of constituent lements of four systems.

As described above, the electrostatic wet-type electrophotographic printer according to this embodiment is for color printing, and includes developers for developing colors, storage tanks, toner cartridges, toner feed pumps, storage tank stirrers, developing solution feedback passages, developing solution drain pumps, developing solution feed pumps, concentration sensors and level sensors in four systems as shown in FIG. 2 to correspond to such colors as yellow (y), magenta (m), cyan (c) and black (k).

On the other hand, the carrier cartridge 4 and the carrier feed pump 6 are provided in a number of one each. The liquid carrier is sent to any desired storage tank by selectively opening any one of the carrier feed valves 18*y*, 18*m*, 18*c* and 18*k* provided between the storage tanks 3*y*, 3*m*, 3*c*, 3*k* and the carrier feed pump 6 and by driving the carrier feed pump 6.

Next, processing operation of the CPU which is the control means will be briefly described with reference to flowcharts of FIGS. 3 to 9.

Figure 3:
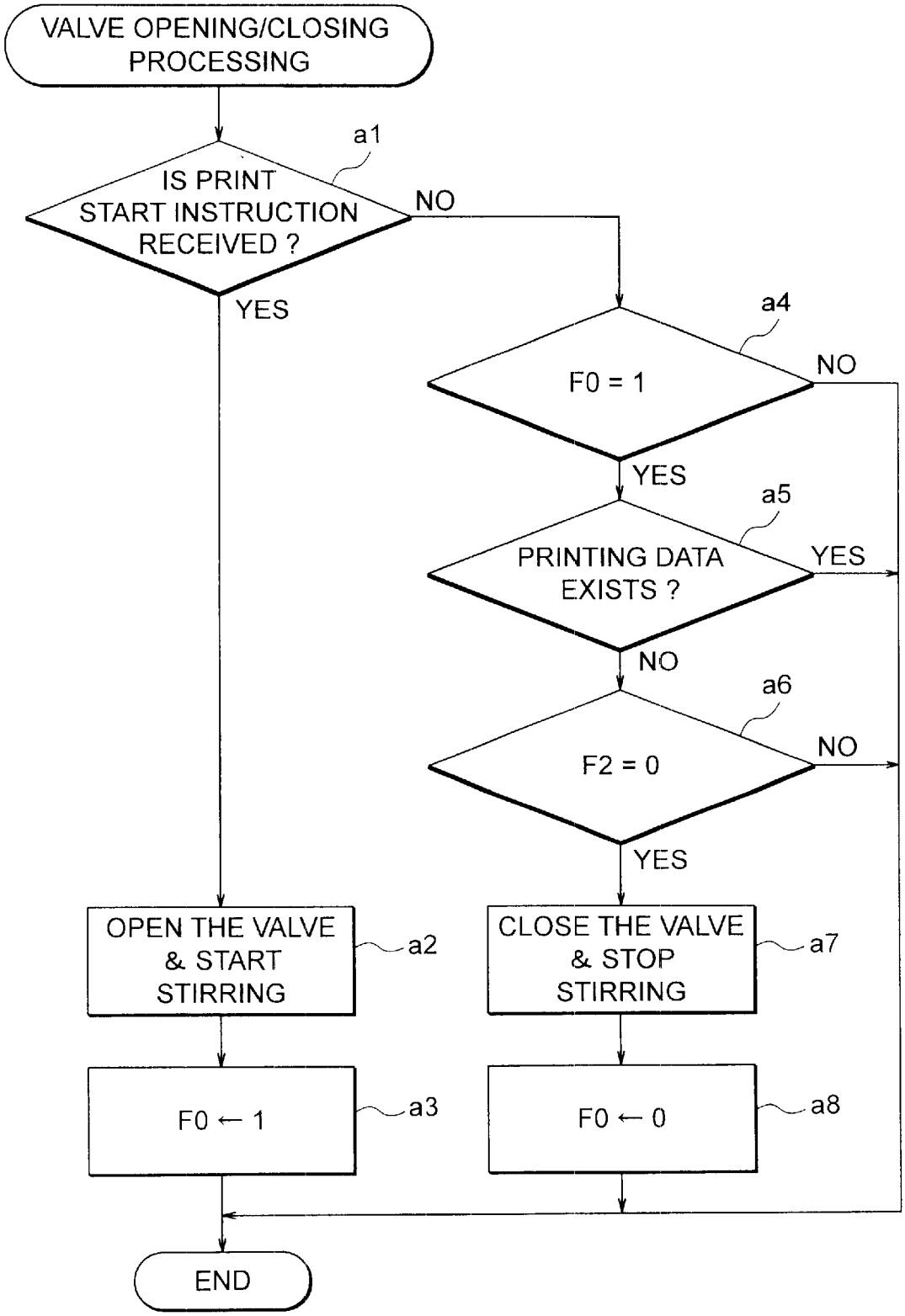
FIG. 3 is a flowchart schematically illustrating a valve opening/closing processing.
Figure 4:
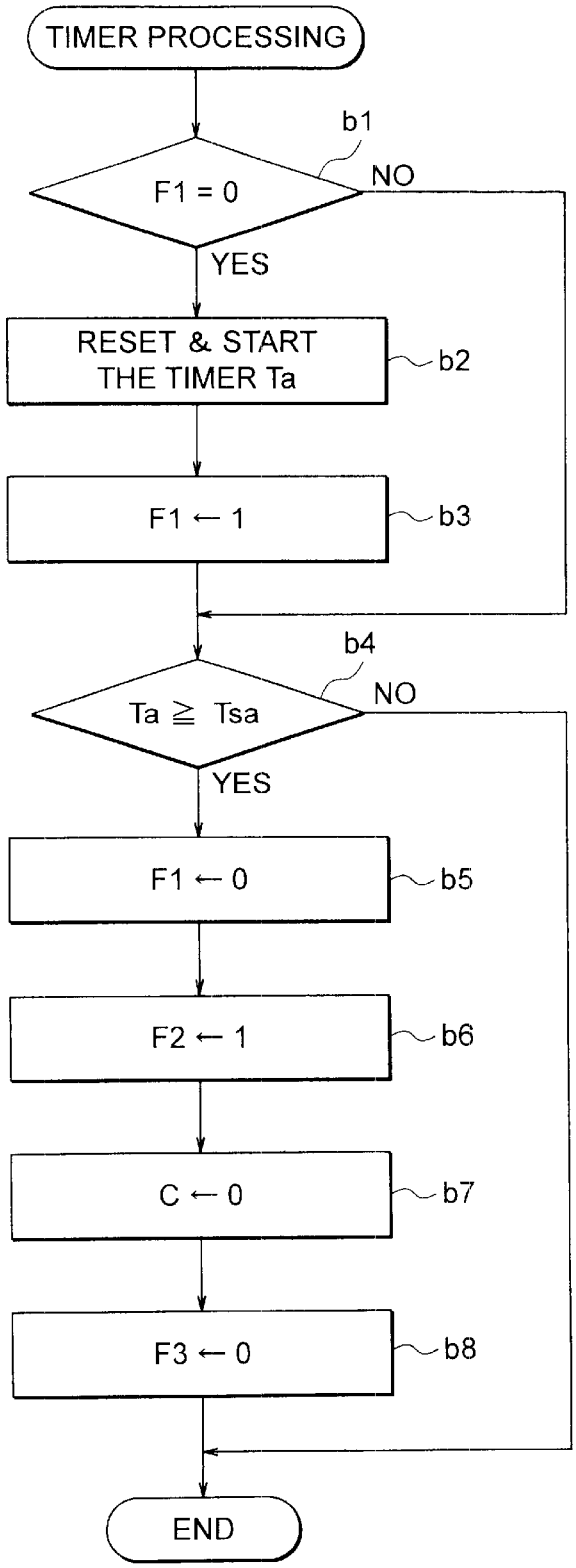
FIG. 4 is a flowchart schematically illustrating a timer processing.
Figure 5:
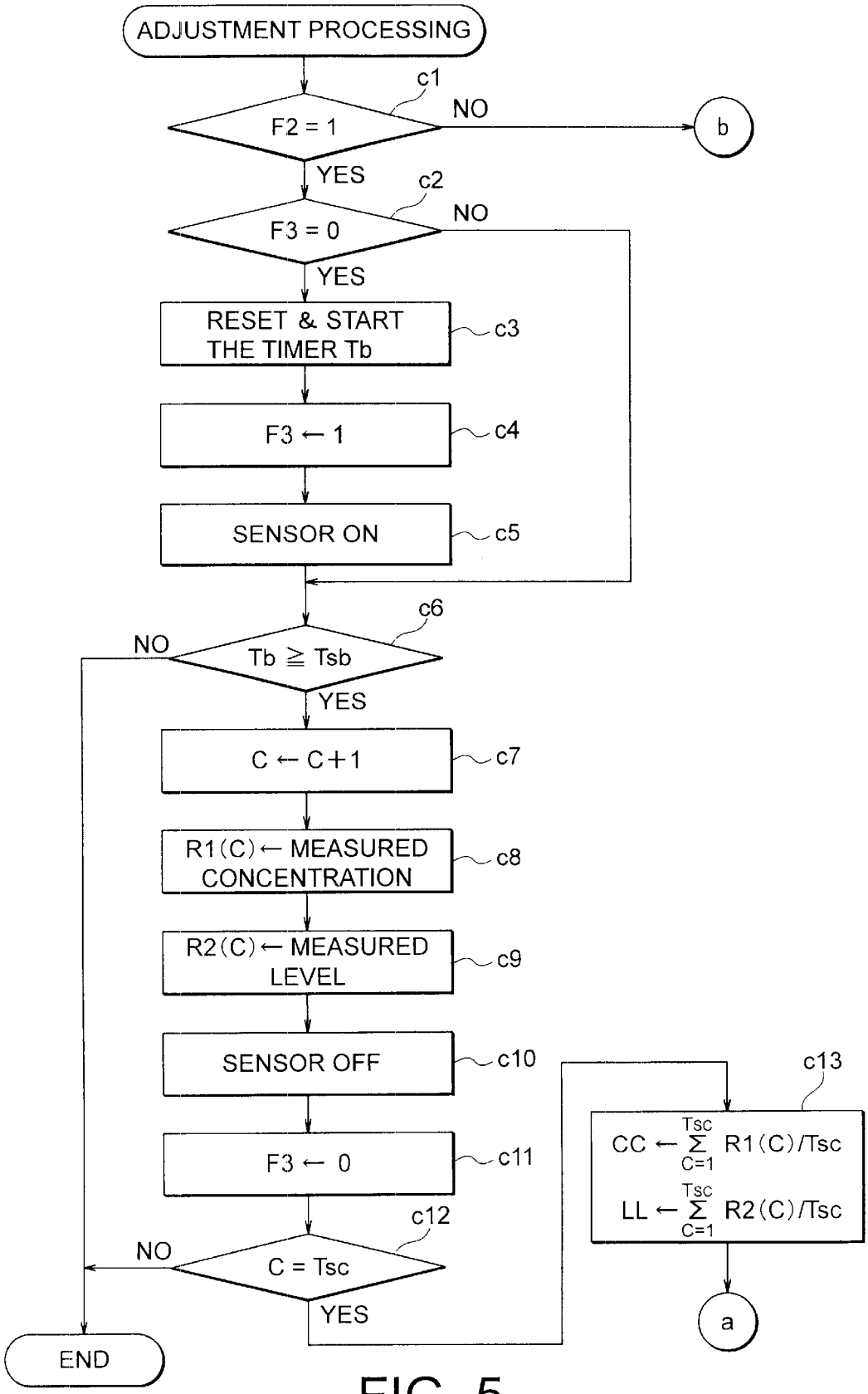
FIG. 5 is a flowchart schematically illustrating an adjustment processing.
Figure 6:
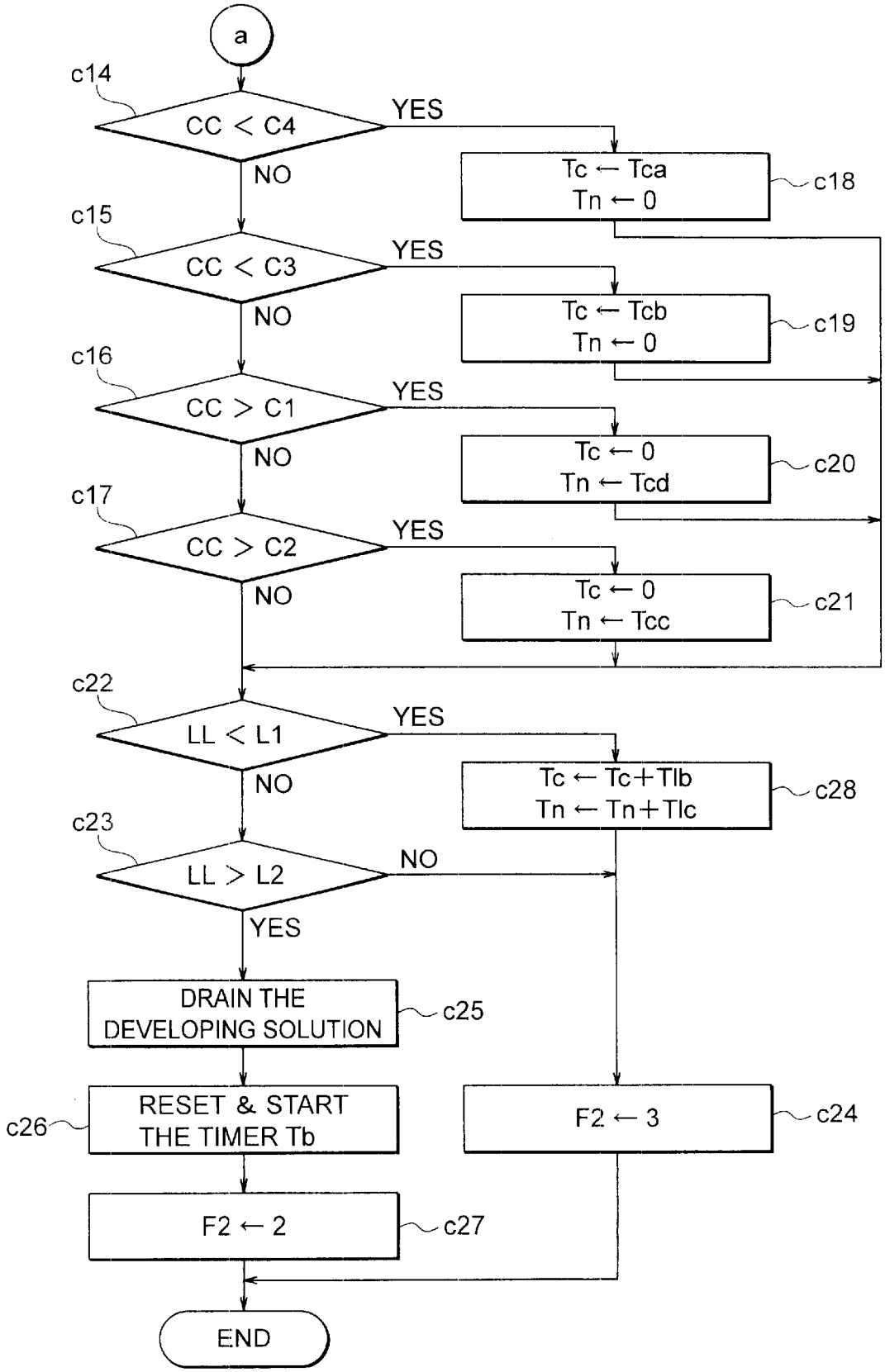
FIG. 6 is a continuation of the flowchart schematically illustrating the adjustment processing.
Figure 7:
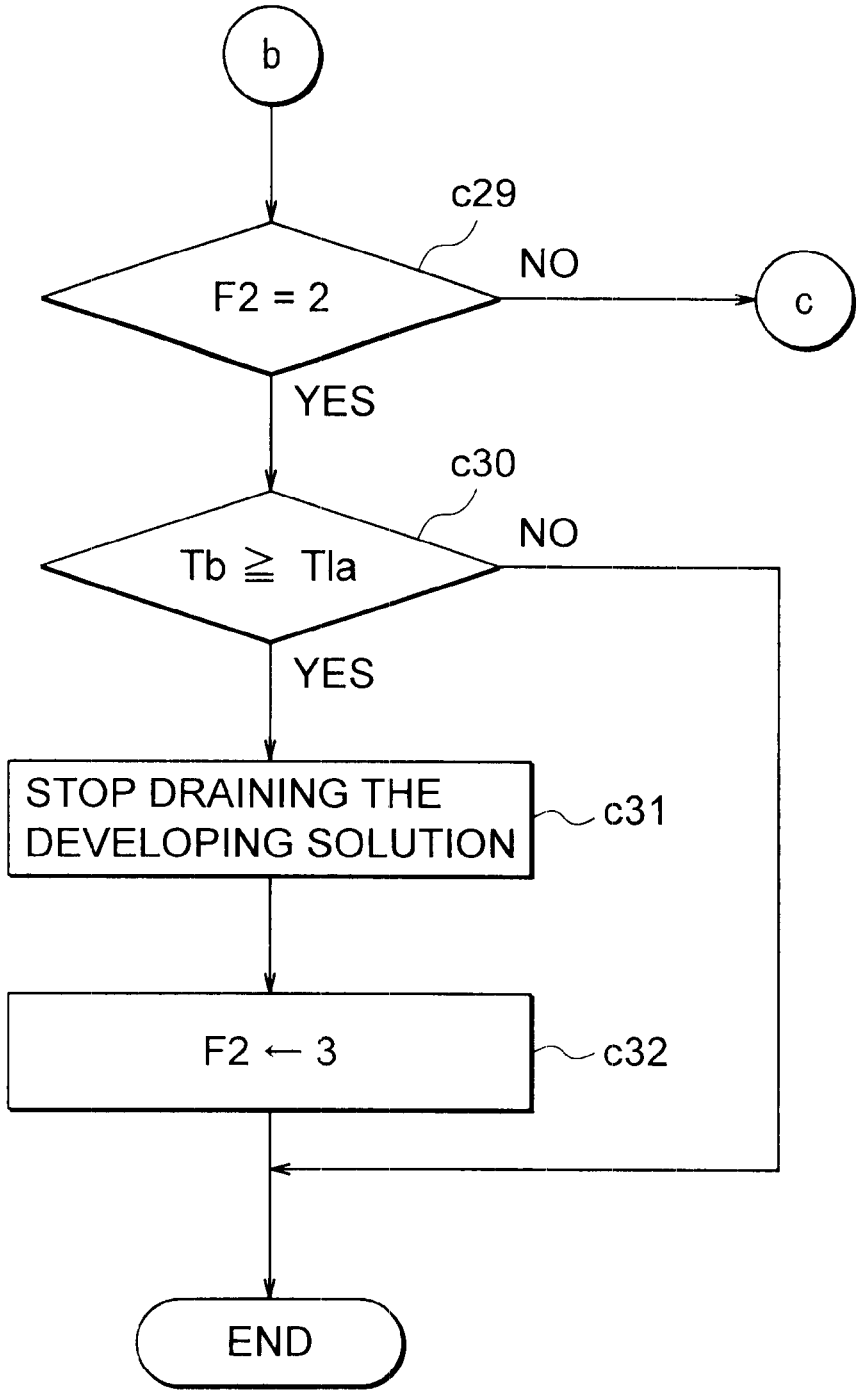
FIG. 7 is a continuation of the flowchart schematically illustrating the adjustment processing.
Figure 8:
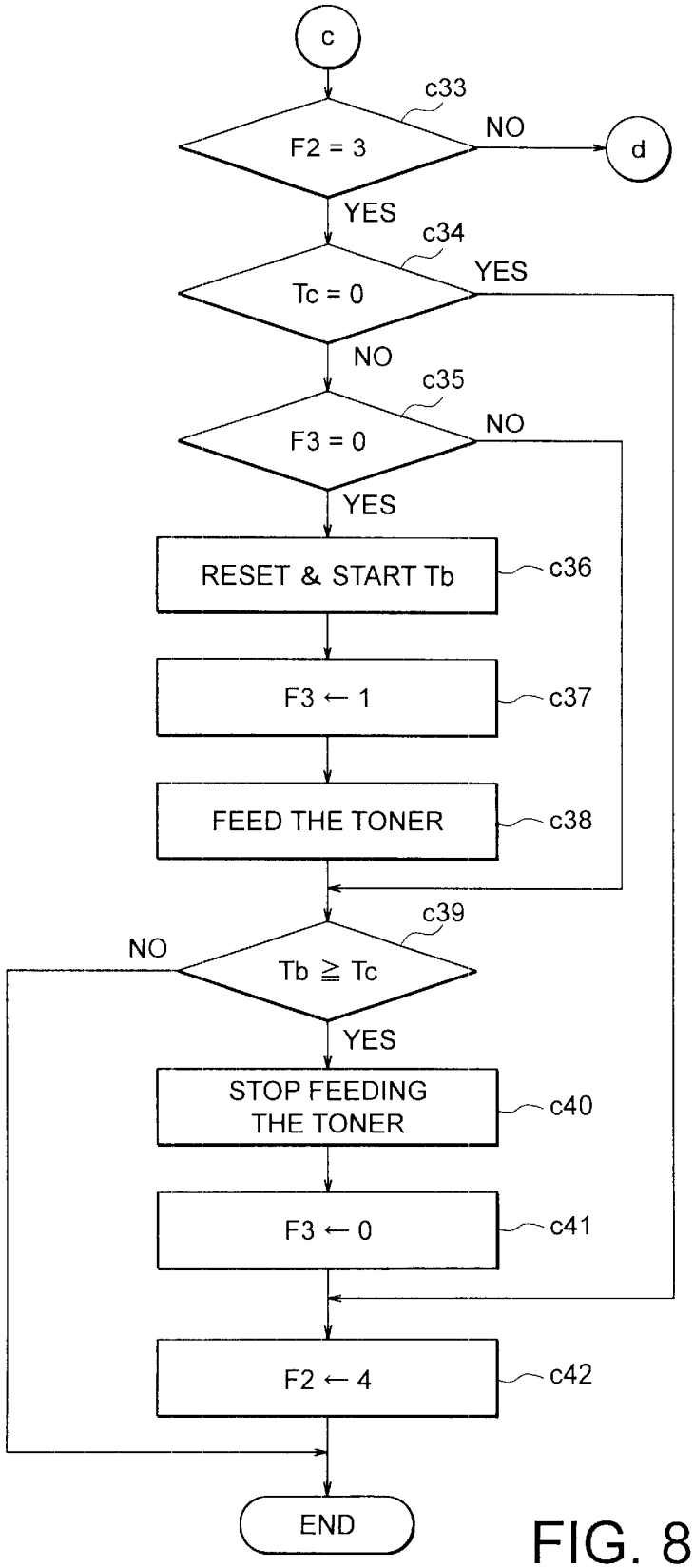
FIG. 8 is a continuation of the flowchart schematically illustrating the adjustment processing.
Figure 9:
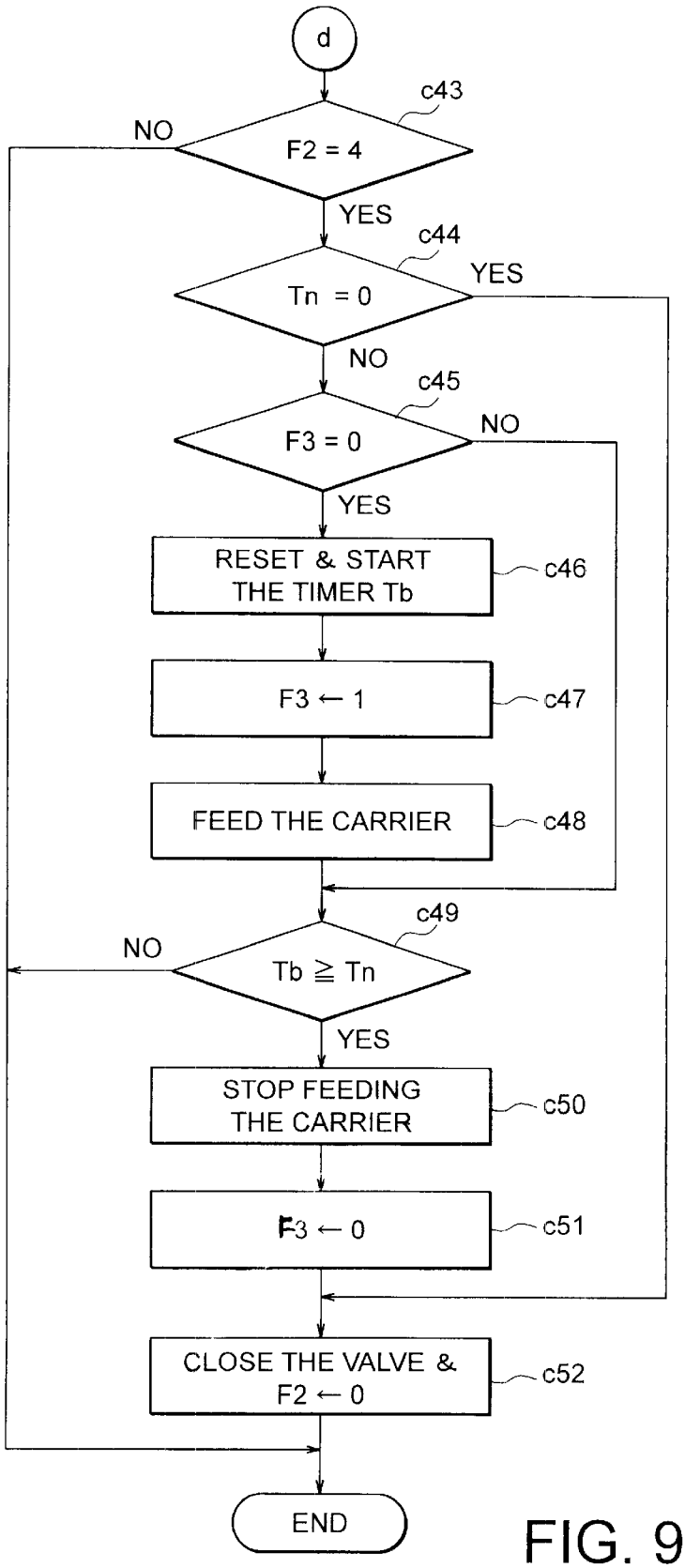
FIG. 9 is a continuation of the flowchart schematically illustrating the adjustment processing.

Among them, FIG. 3 is a flowchart schematically illustrating the valve opening/closing processing related to controlling the opening and closure of the normally-closed valves 16*y* and 17*y*, FIG. 4 is a flowchart schematically illustrating the timer processing for determining the timing for adjusting the concentration and volume of the developing solution, and FIGS. 5 to 9 are flowcharts schematically illustrating the adjustment processing substantially related to adjusting the concentration and volume. All of these processings are repetitively executed at regular intervals by a so-called multi-task processing.

There are many other tasks executed by the CPU, such as the one related to printing, the one related to feeding the papers, etc. They, however, have no direct relationship to the gist of the present invention, and are not described here in detail.

The following description is limited to the control operation related to adjusting the concentration and volume of the developing solution stored in the storage tank 3*y* provided for developing a yellow color, i.e., the control operation concerned to the carrier feed pump 6, toner feed pump 7*y*, developing solution drain pump 10*y*, valve 16*y*, valve 17*y* and valve 18*y*. The processings for adjusting the concentration and volume of the developing solutions stored in the storage tanks 3*m*, 3*c* and 3*k* are quite the same, concerning their substantial processing contents, as the processing for adjusting the developing solution in the storage tank 3*y*, the only difference being related to the toner feed pumps, developing solution drain pumps and valves that are to be controlled.

Therefore, the CPU that has started the valve opening/closing processing (see FIG. 3) judges, first, whether a print start instruction is input, i.e., whether the printing operation be started (step a1). When the print start instruction has not been input, the CPU further judges whether a printing operation execution flag F0, that represents the execution of the printing operation, has been set (step a4).

In a step immediately after the power source circuit is closed, the print start instruction is not usually input. Besides, the printing operation execution flag F0 is reset due to the initialization at the time of closing the power source circuit. Accordingly, the results of judgement at steps a1 and a4 are both no, and the CPU waits for the input of a print start instruction while repeating the judgement processings at steps a1 and a4 in the valve opening/closing processing effected at regular intervals. During this period, the normally-closed valves 16*y* and 17*y* are maintained closed, preventing undesired volatilization of the liquid carrier from the storage tank 3*y*. The storage tank 3*y* is of a completely sealed structure.

When the print start instruction is input while repetitively executing the above processing, the CPU which is means for realizing the valve opening/closing function detects the input of a print start instruction through the judgement at step al, works to open the normally-closed valves 16*y* and 17*y* corresponding to the storage tank 3*y*, actuates the developing solution feed pump 13*y* to circulate the developing solution between the storage tank 3*y* and the developer 2*y* and, at the same time, actuates the stirrers 8*y*, 14 and 15*y* to stir the developing solution, liquid carrier and concentrated toner to be ready for executing the printing. The CPU which is means for realizing the selection function, then, opens the carrier feed valve 18*y* to connect the carrier feed pump 6 to the storage tank 3*y* (step a2). Then, the CPU sets the printing operation execution flag F0, stores the start of the printing operation (step a3), and ends the valve opening/closing processing of this cycle.

With the printing operation execution flag F0 being set, it is judged whether the printing data are remaining through the judgement processing at step a5 after the judgement processings at steps a1 and a4 in the valve opening/closing processing in the next and subsequent cycles. When the printing data are remaining, the CPU ends the valve opening/closing processing of this cycle, and repetitively executes the judgement processings at steps a1, a4 and a5 in the valve opening/closing processing of the next and subsequent cycles until there is no printing data.

Then, when it is confirmed through the judgement processing at step a5 that the printing is finally completed and there is no printing data, the CPU further judges whether an adjustment execution step storage flag F2 has been reset (step a6).

Here, the adjustment execution step storage flag F2 is set by the adjustment processing (see FIGS. 5 to 9) executed by another task that will be described later. The flag F2 is set to a value 1 when the concentration and volume of the developing solution are being measured, is set to a value 2 when the developing solution is being drained, is set to a value 3 when the concentrated toner is being fed, and is set to a value 4 when the liquid carrier is being fed. The flag F2 is completely reset to 0 when none of these processings are executed, i.e., when the processing is not at all executed in relation to adjusting the concentration and volume of the developing solution.

When the judged result at step a6 is yes, it means that no processing has at all been executed for adjusting the concentration and volume of the developing solution. In this case, therefore, the CPU which is means for realizing the valve opening/closing function works to readily halt the operation of the developing solution feed pump 13*y* at a moment when the end of the printing data is confirmed, closes the normally-closed valves 16*y* and 17*y*, interrupts the circulation of the developing solution between the storage tank 3*y* and the developer 2*y* (step a7), resets the printing operation execution flag F0 and stores that a series of print processings are completed (step a8), and ends the valve opening/closing processing of this cycle. Therefore, the normally-closed valves 16*y* and 17*y* are opened only when the printing operation is really carried out, preventing undesired volatilization of liquid carrier from the storage tank 3*y*.

When the processing is thus executed, the printing operation execution flag F0 is reset. In the valve opening/closing processing of the next and subsequent cycles, therefore, the judgement processings only are repetitively executed at steps a1 and a4 in the same manner as described above, and the CPU assumes the stand-by state to wait for the input of a new print start instruction.

When the judged result at step a6 is no, on the other hand, it means that some processing has been executed in relation to adjusting the concentration and volume of the developing solution. In this case, therefore, the CPU which is means for realizing the valve closure delay function ends the valve opening/closing processing of this cycle without executing the processings at steps a7 and a8, and repetitively executes the processings at steps a1 and a4 to a6 in the next and subsequent cycles, and waits for the completion of the processing related to adjusting the concentration and volume of the developing solution.

Finally, therefore, the adjustment execution step storage flag F2 is reset by the adjustment processing (see FIGS. 5 to 9) executed by another task that will be described later. When the completion of the processing related to adjusting the concentration and volume of the developing solution is confirmed through the judgement processing at step a6, the CPU which works as means for realizing the valve closure delay function and also works as means for realizing the valve opening/closing function, executes the processings at steps a7 and a8 to close the valves 16*y* and 17*y*, and assumes the stand-by state to wait for the input of a new print start instruction in the same manner as described above.

Thus, even after the printing operation itself has finished, the processing related to adjusting the concentration and volume of the developing solution is executed up to the end. Besides, during this period, the valves 16*y* and 17*y* are maintained opened, and the developing solution continues to circulate between the storage tank 3*y* and the developer 2*y*. Accordingly, the unadjusted developing solution does not remain in the flow passage between the storage tank 3*y* and the developer 2*y* or in the developer 2*y*, and the processing can be started by using the developing solution of an optimum concentration from the next moment of starting the printing operation.

Next, briefly described below is the processing operation by the CPU in the timer processing (see FIG. 4).

The CPU that has commenced the timer processing, first, judges whether a timer operation condition storage flag F1 has been reset (steps b1). In a step immediately after the power source circuit is closed, however, the value of the flag F1 has been reset due to the initialization processing. Accordingly, the judged result at steps b1 becomes inevitably yes. Therefore, the CPU starts the processing by resetting an execution cycle measuring time Ta which measures the execution cycle of the adjustment processing (step b2), sets the timer operation condition storage flag F1, and stores the fact that the operation of the timer Ta has started (step b3).

Next, the CPU judges whether the time Ta measured by the timer Ta has reached a preset time Tsa of time for executing the adjustment (step b4). In a step immediately after the start of the timer, however, the value Ta is not still reaching Tsa, and the judged results becomes no, and the CPU ends the timer processing of this cycle.

Since the timer operation condition storage flag F1 is set, the judgement processings only are repetitively executed at steps b1 and b4 in the timer processing of the next and subsequent cycles, and the CPU assumes a stand-by state to wait for the passage of the time Tsa to execute the adjustment processing.

It is essential that the preset time Tsa is set to be long enough for executing the processing related to adjusting the concentration and volume of the developing solution, i.e., long enough for executing a series of processings related to measuring the concentration and volume of the developing solution, draining the developing solution, and feeding the concentrated toner and the liquid carrier.

In this embodiment as described with reference to FIG. 2, any one of the carrier feed valves 18*y*, 18*m*, 18*c* and 18*k* is selectively opened to send the liquid carrier in the carrier cartridge 4 into any one of the storage tank 3*y*, 3*m*, 3*c* and 3*k*. Basically, the constitution is such that the liquid carrier is not simultaneously fed to two or more storage tanks.

It is allowable to feed the liquid carrier into two or more storage tanks simultaneously if two or more carrier feed valves are simultaneously opened. It is, however, difficult to separately control the flow rates of the liquid carrier for the storage tanks of which the carrier feed valves are simultaneously opened. The simplest and most reliable method of controlling the amount of the liquid carrier fed into plural storage tanks is to feed the carrier for each of the storage tanks by selecting a carrier feed valve, and the embodiment of this invention employs this method.

Since one carrier feed valve is selectively opened to adjust the concentration and volume of the developing solution for each of the storage tanks, the adjustment processing illustrated in FIGS. 5 to 9 must be independently executed in time series for each of the storage tanks 3*y*, 3*m*, 3*c* and 3*k* of each of the colors, i.e., yellow (y), magenta (m), cyan (c) and black (k). Consequently, the time to be set as a preset time Tsa is about 4 times as long as the time necessary for adjusting the concentration and volume of the developing solution in each storage tank (this is the case where there are four storage tanks).

When it is detected through the judgement processing at step b4 that the time Ta measured by the timer Ta has reached the preset time Tsa while repetitively executing the judgement processings at steps b1 and b4, the CPU resets the timer operation condition storage flag F1 (step b5), sets, to the adjustment execution step storage flag F2, a value 1 that represents the start of measurement of the concentration and volume of the developing solution in the storage tank 3*y* (step b6), resets a measuring frequency counter C and a sub-timer operation condition storage flag F3 (steps b7 and b8), and ends the timer processing of this cycle.

Thus, since the timer operation condition storage flag F1 is reset, the timer processing in the next and subsequent cycles commences a standby processing to wait or the timing for starting the next adjustment processing, i.e., commences the judgement processings at steps b1 and b4.

Next, briefly described below is the processing operation by the CPU in the adjustment processing (see FIGS. 5 to 9).

The CPU that has started the adjustment treatment for the storage tank 3*y*, first, judges whether a value 1 that represents the start of measurement of the concentration and volume of the developing solution has been set to the adjustment execution step storage flag F2 (step c1). This flag F2 is reset by the initialization processing at the time when the power source circuit is closed. In the initial step of when the power source circuit is closed, therefore, the results of judgement at steps c1, c29, c33 and c43 are all no. Accordingly, the CPU repetitively executes the judgement processings only at regular intervals in the adjustment treatment and waits for the setting of a value 1 to the adjustment execution step storage flag F2 by the timer processing described above.

When 1 is set to the adjustment execution step storage flag F2 by the timer processing, the CPU detects this fact through the judgement processing at step c1, and judges whether the sub-timer operation condition storage flag F3 has been reset (step c2). Here, however, the sub-timer operation condition storage flag F3 has already been reset at step b8 in the above timer processing, and the result of judgement at step c2 becomes no.

Hence, the CPU resets and starts the sub-timer Tb that counts the cycle for measuring the concentration and volume of the developing solution (step c3), sets the sub-timer operation condition storage flag F3 and stores the start of operation of the sub-timer Tb (step c4). The CPU that works as means for realizing the selection function, starts the operations of the concentration sensor 11*y* and the level sensor 12*y* disposed in the storage tank 3*y* (step c5), and judges whether the time Tb measured by the sub-timer Tb has reached a preset time interval Tsb for executing the measurement of concentration and volume (step c6). In the present step right after the start of the sub-timer, the measured value of the timer Tb is not reaching Tsb. Accordingly, the result of judgement is no, and the CPU ends the adjustment processing of this period.

With the sub-timer operation condition storage flag F3 being set, the judgement processings only are repetitively executed at steps c1, c2 and c6 in the adjustment processing of the next and subsequent cycles, and the CPU assumes the standby state to wait for the passage of the time Tsb to execute the measurement of the concentration and volume.

When it is detected by the judgement processing at step c6 that the time Tb measured by the sub-timer Tb has reached the preset time Tsb while repeating the judgement processings, the CPU which is means for realizing the selection function increases the value of the measuring frequency counter C (step c7) and stores the value of concentration of the developing solution detected by the concentration sensor 11*y* of the storage tank 3*y* in a sampling concentration storage register R1(*c*) (step c8), temporarily stores the volume of the developing solution detected by the level sensor 12*y* in the sampling volume storage register R2(*c*) (step c9), once initializes the concentration sensor 11*y* and the level sensor 12*y* (step c10), and resets the sub-timer operation condition storage flag F3 (step c11).

Next, the CPU judges whether the value of the measuring frequency counter C has reached a preset measuring frequency Tsc (step c12). When the value of the counter C has not reached the preset measuring frequency Tsc, it means that the concentration and volume of the developing solution in the storage tank 3*y* must be repetitively executed. Therefore, the CPU ends the adjustment processing of this cycle, and repeats the second and subsequent measurement in the same manner as described above in the adjustment processing of the next and subsequent cycles.

When it is detected by the judgement at step c12 that the value of the counter C has finally reached the preset measuring frequency Tsc, the CPU accumulates the value of the developing solution concentration stored in the sampling concentration storage register R1(*c*) of c=1 to Tsc and divides it by the measuring frequency Tsc, determines the measured value (average value) of final concentration to store it in a measured concentration storage register CC, accumulates the value of volume of the developing solution stored in the sampling volume storage register R2(*c*) of c=1 to Tsc and divides it by the measuring frequency Tsc, determines the measured value (average value) of the final volume and stores it in a measured volume storage register LL (step c13).

Then, the CPU judges whether an average value CC of the measured concentration of the developing solution in the storage tank 3*y* is smaller than a judged value C4 (step c14), smaller than a judged value C3 (step c15), larger than a judged value C1 (step c16), and is larger than a determined value C2 (step c17), and sets a time Tc for feeding the concentrated toner to the storage tank 3*y* and a time Tn for feeding the liquid carrier to the storage tank 3*y* depending upon the concentration of the developing solution (steps c18 to c21).

Here, the judged values maintain a relationship C4<C3<C2<C1, and a value in a range C3 to C4 roughly represents a proper toner concentration. Further, preset times Tca and Tcb for feeding the concentrated toner have a relationship Tca>Tcb, and preset times Tcc and Tcd for feeding the concentrated toner have a relationship Tcc<Tcd. In effect, when the toner concentration is very low, the toner feed pump 7*y* only is driven for a long preset time Tca. When the toner concentration is low to some extent, the toner feed pump 7*y* only is driven for a short preset time Tcb to increase the toner concentration of the developing solution. When the toner concentration is very high, on the other hand, the carrier feed pump 6 only is driven for a long preset time Tcd. When the toner concentration is high to some extent, the carrier feed pump 6 only is driven for a short preset time Tcc to decrease the toner concentration of the developing solution.

Further, when the toner concentration lies within a proper range of from C3 to C4, i.e., when the judged results at steps c14 to c17 are all no, the values of the registers Tc and Tn are both maintained at an initial value of 0, and neither the toner feed pump 7*y* nor the carrier feed pump 6 is driven. Here, however, Tc and Tn may often be corrected for finally adjusting the volume (see step c28). Therefore, the results of settings at steps c18 to c21 are not necessarily a direct reflection of the operation times of the toner feed pump 7*y* and of the carrier feed pump 6.

Next, the CPU judges whether the average value LL of the measured volume of the developing solution in the storage tank 3*y* is smaller than a judged value L1 (step c22) or is larger than a judged value L2 (step c23).

Here, the judged values have a relationship L1<L2. When the average value LL of the measured volume is larger than the judged value L2, it means that the volume of the developing solution is very large and when the average value LL of the measured volume is smaller than the judged value L1, it means that the volume of the developing solution is very small. When the average value LL of the measured volume is in a range of from L1 to L2, it means that the volume is roughly proper.

Therefore, when the judged result at step c22 is no and the judged result at step c23 is yes, i.e., when it is judged that the volume of the developing solution is very large, the CPU which is means for realizing the function for controlling the developing solution drain pump, starts draining the developing solution by driving the developing solution drain pump 10*y* of the storage tank 3*y* (step c25), resets and starts the sub-timer Tb for measuring the operation time of the developing solution drain pump 10*y* (step c26), sets a value 2 that represents the start of the developing solution drain processing to the adjustment execution step storage flag F2 (step c27), and ends the adjustment processing of this cycle.

When the judged result at step c22 is yes, i.e., when it is judged that the volume of the developing solution is very small, the CPU which is means for realizing the function for feeding the developing solution of a standard concentration, adds correction values T1*b* and T1*c* to a value of the register Tc of which the time for feeding the concentrated toner is set depending upon the concentration of the developing solution and to a value of the register Tn of which the time for feeding the liquid carrier is set depending upon the concentration of the developing solution. The CPU, then, corrects the preset operation times Tc, Tn of the toner feed pump 7*y* and the carrier feed pump 6, so that the toner and the liquid carrier are fed into the storage tank 3*y* for periods of time longer than the time set by the processings at steps c18 to c21 (step c28).

The correction values T1*b* and T1*c* have been so adjusted that the developing solution formed by operating the toner feed pump 7*y* for T1*b* seconds and by operating the carrier feed pump 6 for T1*c* seconds becomes a developing solution of a standard concentration. Unlike the device of the prior art, therefore, there does not occur such a problem that the toner concentration of the developing solution varies (decreases) at the time of feeding the developing solution since the liquid carrier only is fed.

When the processing at step c28 is executed due to the lack of the developing solution as described above, the processings at steps c25 to c27 related to the draining of the developing solution are skipped. Accordingly, the CPU sets the value 3 which represents the start of the processing for feeding the concentrated toner to the adjustment execution step storage flag F2 (step c24), and ends the adjustment processing of this cycle.

On the other hands, when the judged results at steps c22 and c23 are no, i.e., when it is judged that the amount of the developing solution in the storage tank 3*y* is in a proper range of from L1 to L2, both the drain processing for decreasing the developing solution and the feed processing for increasing the developing solution must be skipped. Therefore, the CPU executes none of the processings of steps c25 to c27 and c28, sets a value 3 that represents the start of the processing for feeding the concentrated toner to the adjustment execution step storage flag F2 (step c24), and ends the adjustment processing of this cycle.

Here, when the processing at step c27 is executed, and a value 2 that represents the start of the processing for draining the developing solution is set to the adjustment execution step storage flag F2, judgement processing is executed at step c1 in the adjustment processing of a next cycle, and the value is detected at the judgement processing at step c29.

The CPU judges whether the measured value of the sub-timer Tb actuated by the processing at step c26 has reached the preset time T1*a* for draining the developing solution (step c30). When the measured value Tb is not reaching the preset value T1*a*, the CPU repetitively executes the judgement processings at steps c1, c29 and c30 in the adjustment processing in the next and subsequent cycles, and waits for until the measured value of the sub-timer Tb reaches the preset value T1*a*. During this period, the developing solution drain pump 10*y* of the storage tank 3*y* continues to operate.

When it is detected through the judgement processing at step c30 that the measured value of the sub-timer Tb has finally reached the preset value T1*a* and the preset time for operating the developing solution drain pump 10*y* has elapsed, the CPU which is means for realizing the function for controlling the developing solution drain pump interrupts the operation of the developing solution drain pump 10*y* for the storage tank 3*y* (step c31), sets the value 3 representing the start of the processing for feeding the concentrated toner to the adjustment execution step storage flag F2 (step c32), and ends the adjustment processing of this cycle. As described earlier, the developing solution drain processing is executed only when it is judged that the amount of the developing solution is too large.

Besides, even when the concentration of the developing solution must be adjusted, i.e., even when the concentrated toner must be fed or the liquid carrier must be fed, the developing solution drain processing is executed prior to the above processing. Therefore, despite the concentrated toner and the liquid carrier are thrown into the storage tank 3*y*, the developing solution does not undesirably overflow from the storage tank 3*y*.

On the other hand, when the processing at step c24 is executed and the value 3 representing the start of the processing for feeding the concentrated toner is set to the adjustment execution step storage flag F2, or when the processing for draining the developing solution is completed and the value 3 is set to the adjustment execution step storage flag F2 due to the processing at step c32, the judgement processings are executed at steps c1 and c29 in the adjustment processing of the next cycle, and the value 3 is detected through the judgement processing at step c33.

In this case, the CPU judges whether the preset time Tc for operating the toner feed pump 7*y* set through the processings at steps c18 to c21 or set through the processing at step c28, is 0, i.e., judges whether the toner feed pump 7*y* must really be driven (step c34).

When the preset operation time Tc has been set to 0, the toner feed pump 7*y* needs not be driven. Therefore, the CPU skips the processing related to driving the toner feed pump 7*y* of the storage tank 3*y*, sets a value 4 that represents the start of the processing for feeding the liquid carrier to the adjustment execution step storage flag F2 (step c42), and ends the adjustment processing of this cycle.

When the preset operation time Tc has been set to a value other than 0, it means that the toner feed pump 7*y* must be driven. Therefore, the CPU judges whether the sub-timer operation condition storage flag F3 has been reset, i.e., judges whether the sub-timer Tb has already been driven to monitor the passage of time after the start of the operation of the toner feed pump 7*y* (step c35).

When the sub-timer operation condition storage flag F3 is maintained in a reset state, it means that the toner feed pump 7*y* has not been operated yet. Therefore, the CPU resets and starts the sub-timer Tb (step c36), and sets the sub-timer operation condition storage flag F3 that stores the start of operation of the sub-timer Tb (step c37).

Next, the CPU which is means for realizing the selection function starts driving the toner feed pump 7*y* of the storage tank 3*y* (step c38), judges whether the time measured by the sub-timer Tb has reached the time Tc for feeding the concentrated toner (step c39), and ends the adjustment processing of this cycle when the time Tc has not been reached.

With the sub-timer operation condition storage flag F3 being set, the judgement processings only are repetitively executed at steps c1, c29, c33 to c35 and at step c39 in the adjustment processing of the next and subsequent cycles, and the toner feed pump 7y is continuously driven during this period.

When it is detected by the judgement processing at step c39 that the time Tb for operating the toner feed pump 7y has finally reached the preset value Tc, the CPU which is means for realizing the selection function interrupts the operation of the toner feed pump 7y (step c40), resets the sub-timer operation condition storage flag F3 (step c41), sets a value 4 that represents the start of the liquid carrier feed processing to the adjustment execution step storage flag F2 (step c42) and ends the adjustment processing of this period.

When the amount of the developing solution is very large in the storage tank 3y, the developing solution adjustment processing is executed in advance to decrease the amount of the developing solution as described earlier. Even when the concentrated toner is fed, therefore, no overflow takes place.

The value 4 thus set to the adjustment execution step storage flag F2 through the processing at step c42 is then detected through the judgement processing at step c43 after the judgement processings are executed at steps c1, c29 and c33 in the adjustment processing of the next cycle.

Next, the CPU judges whether the value of the preset time Tn for operating the carrier feed pump 6 set by the processing at steps C18 to c21 or at step C28, is 0, i.e., whether the carrier feed pump 6 must be driven (step c44). Here, when the preset operation time Tn has been set to 0, there is no need of driving the carrier feed pump 6. Therefore, the CPU skips the processing related to driving the carrier feed pump 6 of the storage tank 3y, closes the carrier feed valve 18y, resets the value of the adjustment execution step storage flag F2 (step c52), and ends the adjustment processing of this cycle.

In this case, a series of processings have all been completed concerning measuring the concentration and volume of the developing solution in the storage tank 3y, draining the developing solution, and feeding the concentrated toner and the liquid carrier, and have been returned to the initial state. The CPU, then, repetitively executes the judgment processings only at steps c1, c29, c33 and c43 in the adjustment processing of the next and subsequent cycles, and assumes the standby state to wait for the setting of a value 1 to the adjustment execution step storage flag F2 by the timer processing, the value 1 representing the start of measurement of the concentration and volume of the developing solution in the storage tank 3y.

When a value other than 0 has been set to be a preset operation time Tn, it means that the carrier feed pump 6 must be driven. Therefore, the CPU judges whether the sub-timer operation condition storage flag F3 has been reset, i.e., whether the sub-timer Tb has already been started to monitor the passage of time after the start of the carrier feed pump 6 (step c45).

When the sub-timer operation condition storage flag F3 has been maintained reset, it means that the carrier feed pump 6 has not been started yet. Therefore, the CPU resets and starts the sub-timer Tb (step c46), and sets the sub-timer operation condition storage flag F3 to store the start of the sub-timer Tb (step c47).

Next, the CPU drives the carrier feed pump 6 to feed the liquid carrier to the storage tank 3y (step c48), judges whether the time measured by the sub-timer Tb has reached the time Tn for feeding the liquid carrier set by the processing at steps c18 to c21 or at step c28 (step c49), and ends the adjustment processing of this cycle when the feeding time Tn has not been reached.

With the sub-timer operation condition storage flag F3 being set, the judgement processings only are repetitively executed at steps c1, c29, c33, c43 to c45 and at step c49 in the adjustment processing of the next and subsequent cycles, and the carrier feed pump 6 is continuously driven during this period.

Since the carrier feed valve 18y only is opened by the processing at step a2 in the valve opening/closing processing described above, the carrier feed pump 6 is driven to reliably feed the liquid carrier into the storage tank 3y only.

When it is detected by the judgement processing at step c49 that the time Tb for operating the carrier feed pump 6 has finally reached the preset time Tn, the CPU interrupts the operation of the carrier feed pump 6 (step c50), and resets the sub-timer operation condition storage flag F3 (step c51). Further, the CPU which is means for realizing the selection function closes the carrier feed valve 18y, resets the value of the adjustment execution step storage flag F2 (step c52), and ends the adjustment processing of this cycle.

When the amount of the developing solution in the storage tank 3y is very large, the developing solution adjustment processing is executed in advance to decrease the amount of the developing solution as described earlier. Even when the liquid carrier is fed, therefore, no overflow takes place.

Upon executing the processing at step c52, the processings are all completed concerning adjusting the toner concentration and volume of the developing solution in the storage tank 3y.

Then, the CPU repetitively executes the judgement processings at steps c1, c29, c33 and c43 in the adjustment processing of the next and subsequent cycles, and assumes the standby state to wait for the setting of a value 1 to the adjustment execution step storage flag F2 by the timer processing, the value 1 representing the start of measurement of the concentration and volume of the developing solution in the storage tank 3y.

In the foregoing was described the adjustment of the toner concentration and volume of the developing solution in the storage tank 3y. Concerning the adjustment of the developing solutions in the storage tanks 3m, 3c or the developing solution in the storage tank 3k, flow of the processing is substantially the same as that of the case of the storage tank 3y described above. Therefore, processings equal to the processings described above may be repetitively executed by successively changing over the toner feed pumps and the developing solution drain pumps that are to be driven, and by successively changing over the carrier feed valves that are to be opened and the concentration sensors and level sensors from which the measured values are to be read out. As described earlier, the timer setpoint value Tsa for determining the timing for starting the adjustment processing has been set maintaining a time interval long enough for time-serially and continuously executing the adjustment processing for all of the four storage tanks 3y, 3m, 3c and 3k. Therefore, the adjustment processing can be reliably executed by selecting any one of the carrier feed valves 18y, 18m, 18c and 18k.

The processings related to adjusting the concentration and volume in the storage tanks 3y, 3m, 3c and 3k are independently executed by the task processing at regular intervals, without being interfered by other processings related to printing or feeding papers and can, hence, be executed in parallel even during the execution of printing.

Since the adjustment processing related to the concentration and volume of the developing solution is executed by the task processing in parallel with the printing operation, no fluctuation occurs in the concentration and volume of the developing solution during the operation no matter how long the printing operation is conducted, and it is allowed to continue the printing operation for extended periods of time.

According to the device for adjusting a developing solution for an electrostatic wet-type electrophotographic printer of the present invention, the carrier feed pump and the toner feed pump are driven and controlled in real time based upon values detected by the concentration sensor and the level sensor during the printing operation, in order to adjust the volume and the toner concentration of the developing solution in the storage tank so as to lie within predetermined ranges. Therefore, the printing operation can be stably continued for extended periods of time maintaining the toner concentration and volume of the developing solution within proper ranges at all times.

Further, since a developing solution drain pump is used as developing solution drain means for draining excess of developing solution, the developing solution is prevented from undesirably overflowing from the storage tank. Besides, the concentration is suitably adjusted upon feeding the concentrated toner and the liquid carrier to the developing solution that has been stored in the storage tank in the step of measuring the concentration and volume, and the concentration is stably adjusted during the printing operation.

In replenishing the volume of the developing solution, further, the carrier feed pump and the toner feed pump are driven for only a preset period of time to feed the developing solution of a predetermined concentration. Unlike the conventional device that replenishes the amount of the developing solution by feeding the liquid carrier only, therefore, the toner concentration does not vary even in replenishing the volume of the developing solution.

Moreover, the storage tank is of a sealed structure, normally-closed valves are disposed between the developer and the storage tank and in the developing solution feedback passage, and the valves are opened only when the printing operation is being executed but are closed when the printing operation is not effected. Therefore, the liquid carrier does not volatilize from the storage tank preventing a change in the concentration of the developing solution.

Besides, even after the end of the printing operation, the valves are maintained opened so far as the volume and the toner concentration of the developing solution are adjusted in the storage tank until the end of the adjusting operation of the developing solution. Even in case the adjustment of the volume and the toner concentration of the developing solution is started just prior to ending the printing operation, therefore, the unadjusted developing solution does not remain in the flow passage connecting the storage tank to the developer, and the printing commences by using a developing solution of an optimum concentration from a moment when the printing operation is started next.

Even in effecting the color printing, only one carrier cartridge and one carrier feed pump need be employed irrespective of the number of colors, without driving up the cost of the device.

What is claimed is:

1. A device for adjusting a developing solution for an electrostatic wet-type electrophotographic printer comprising:

a storage tank for storing the developing solution;

a carrier cartridge for storing a liquid carrier;

a toner cartridge for storing a concentrated liquid toner;

a carrier feed pump for feeding the liquid carrier in the carrier cartridge into the storage tank;

a toner feed pump for feeding the concentrated toner in the toner cartridge into the storage tank;

a storage tank stirrer for stirring the liquid carrier and the concentrated toner fed into the storage tank to prepare a developing solution;

a developer for effecting the developing with the developing solution fed from the storage tank;

a developing solution feedback passage for feeding the developing solution used by the developer back to the storage tank; and developing solution drain means for draining an excess of the developing solution in the storage tank into the toner cartridge;

wherein provision is further made of:

a concentration sensor for measuring the toner concentration of the developing solution in the storage tank;

a level sensor for measuring the volume of the developing solution in the storage tank; and control means for controlling, in real time, the carrier feed pump and the toner feed pump based upon values detected by the concentration sensor and the level sensor during the printing operation, in order to adjust the volume and the toner concentration of the developing solution in the storage tank so as to lie within predetermined ranges, wherein the storage tank is of a sealed structure, normally-closed valves are disposed between the developer and the storage tank and in the developing solution feedback passage, and the control means is provided with a valve opening/closing function for opening or closing the valves upon detecting the start and end of the printing operation.

2. A device for adjusting a developing solution for an electrostatic wet-type electrophotographic printer according to claim 1, wherein the control means is provided with a valve closure delay function for inhibiting the closure of the valves at the time of adjusting the volume and the toner concentration of the developing solution in the storage tank.

3. A device for adjusting a developing solution for an electrostatic wet-type electrophotographic printer according to claim 2, wherein the storage tanks, storage tank stirrers, toner cartridges, toner feed pumps, developing solution feed pumps, developing solution feedback passages, concentration sensors and level sensors are provided in a plural number to meet the number of the developers, but the carrier cartridge and the carrier feed pump are provided in a number of one, respectively, the storage tanks and the carrier feed pumps are connected together through the normally-closed carrier feed valves provided for the storage tanks, and the control means is provided with a selection function for selecting a toner feed pump, a developing solution drain pump, a concentration sensor, and a level sensor and a carrier feed valve to be opened, that are corresponding to a storage tank in which the volume and the toner concentration are to be adjusted.

4. A device for adjusting a developing solution for an electrostatic wet-type electrophotographic printer according to claim 1, wherein the storage tanks, storage tank stirrers, toner cartridges, toner feed pumps, developing solution feed pumps, developing solution feedback passages, concentration sensors and level sensors are provided in a plural number to meet the number of the developers, but the carrier cartridge and the carrier feed pump are provided in a number of one, respectively, the storage tanks and the carrier feed pumps are connected together through the normally-closed carrier feed valves provided for the storage tanks, and the control means is provided with a selection function for selecting a toner feed pump, a developing solution drain pump, a concentration sensor, and a level sensor and a carrier feed valve to be opened, that are corresponding to a storage tank in which the volume and the toner concentration are to be adjusted.

5. A device for adjusting a developing solution for an electrostatic wet-type electrophotographic printer, comprising:

a storage tank for storing the developing solution;

a carrier cartridge for storing a liquid carrier;

a toner cartridge for storing a concentrated liquid toner;

a carrier feed pump for feeding the liquid carrier in the carrier cartridge into the storage tank;

a toner feed pump for feeding the concentrated toner in the toner cartridge into the storage tank;

a storage tank stirrer for stirring the liquid carrier and the concentrated toner fed into the storage tank to prepare a developing solution;

a developer for effecting the developing with the developing solution fed from the storage tank;

a developing solution feedback passage for feeding the developing solution used by the developer back to the storage tank;

developing solution drain means for draining an excess of the developing solution in the storage tank into the toner cartridge;

a concentration sensor for measuring the toner concentration of the developing solution in the storage tank;

a level sensor for measuring the volume of the developing solution in the storage tank; and control means for controlling, in real time, the carrier feed pump and the toner feed pump based upon values detected by the concentration sensor and the level sensor during the printing operation, in order to adjust the volume and the toner concentration of the developing solution in the storage tank so as to lie within predetermined ranges, wherein the storage tanks storage tank stirrers, toner cartridges, toner feed pumps, developing solution feed pumps, developing solution feedback passages, concentration sensors and level sensors are provided in a plural number to meet the number of the developers, but the carrier cartridge and the carrier feed pump are provided in a number of one, respectively, the storage tanks and the carrier feed pumps are connected together through the normally-closed carrier feed valves provided for the storage tanks, and the control means is provided with a selection function for selecting a toner feed pump, a developing solution drain pump, a concentration sensor, and a level sensor and a carrier feed valve to be opened, that are corresponding to a storage tank in which the volume and the toner concentration are to be adjusted.

6. A device for adjusting a developing solution for an electrostatic wet-type electrophotographic printer, comprising:

a storage tank for storing the developing solution;

a carrier cartridge for storing a liquid carrier;

a toner cartridge for storing a concentrated liquid toner;

a carrier feed pump for feeding the liquid carrier in the carrier cartridge into the storage tank;

a toner feed pump for feeding the concentrated toner in the toner cartridge into the storage tank;

a storage tank stirrer for stirring the liquid carrier and the concentrated toner fed into the storage tank to prepare a developing solution;

a developer for effecting the developing with the developing solution fed from the storage tank;

a developing solution feedback passage for feeding the developing solution used by the developer back to the storage tank;

developing solution drain means for draining an excess of the developing solution in the storage tank into the toner cartridge;

a concentration sensor for measuring the toner concentration of the developing solution in the storage tank;

a level sensor for measuring the volume of the developing solution in the storage tank; and control means for controlling, in real time, the carrier feed pump and the toner feed pump based upon values detected by the concentration sensor and the level sensor during the printing operation, in order to adjust the volume and the toner concentration of the developing solution in the storage tank so as to lie within predetermined ranges, wherein the developing solution drain means comprises a developing solution drain pump, and the control means includes a function for controlling the developing solution drain pump to control the developing solution drain pump in addition to controlling the carrier feed pump and the toner feed pump, and wherein the storage tank comprises a sealed structure, normally-closed valves are disposed between the developer and the storage tank and in the developing solution feedback passage, and the control means is provided with a valve opening/closing function for opening or closing the valves upon detecting the start and end of the printing operation.

7. A device for adjusting a developing solution for an electrostatic wet-type electrophotographic printer, comprising:

a storage tank for storing the developing solution;

a carrier cartridge for storing a liquid carrier;

a toner cartridge for storing a concentrated liquid toner;

a carrier feed pump for feeding the liquid carrier in the carrier cartridge into the storage tank;

a toner feed pump for feeding the concentrated toner in the toner cartridge into the storage tank;

a storage tank stirrer for stirring the liquid carrier and the concentrated toner fed into the storage tank to prepare a developing solution;

a developer for effecting the developing with the developing solution fed from the storage tank;

a developing solution feedback passage for feeding the developing solution used by the developer back to the storage tank;

developing solution drain means for draining an excess of the developing solution in the storage tank into the toner cartridge;

a concentration sensor for measuring the toner concentration of the developing solution in the storage tank;

a level sensor for measuring the volume of the developing solution in the storage tank; and control means for controlling, in real time, the carrier feed pump and the toner feed pump based upon values detected by the concentration sensor and the level sensor during the printing operation, in order to adjust the volume and the toner concentration of the developing solution in the storage tank so as to lie within predetermined ranges, wherein the control means includes a function for feeding the developing solution of a standard concentration by driving the carrier feed pump and the toner feed pump for only a preset period of time in replenishing the volume of the developing solution, and wherein the storage tank comprises a sealed structure, normally-closed valves are disposed between the developer and the storage tank and in the developing solution feedback passage, and the control means is provided with a valve opening/closing function for opening or closing the valves upon detecting the start and end of the printing operation.

8. A device for adjusting a developing solution for an electrostatic wet-type electrophotographic printer, comprising:

a storage tank for storing the developing solution;

a carrier feed pump for feeding a carrier into said storage tank;

a toner feed pump for feeding a toner into said storage tank;

a storage tank stirrer for mixing said carrier and said toner into said developing solution in said storage tank;

a developer for effecting a developing with said developing solution fed from said storage tank;

a developing solution feedback passage for feeding the developing solution used by the developer back to said storage tank;

a developing solution drain for draining an excess of the developing solution in said storage tank;

a concentration sensor for measuring a toner concentration of the developing solution in said storage tank;

a level sensor for measuring a volume of the developing solution in said storage tank;

a controller for controlling said carrier feed pump and said toner feed pump based upon values detected by said concentration sensor and said level sensor in order to control the volume and the toner concentration of the developing solution in said storage tank within predetermined ranges at all times during a printing operation; and valves located between said developer and said storage tank, said valves being opened by said controller during said printing operation and closed during a non-printing operation.

* * * * *